US007144100B2

(12) United States Patent
Hill et al.

(10) Patent No.: US 7,144,100 B2
(45) Date of Patent: Dec. 5, 2006

(54) PURGEABLE PRINT HEAD RESERVOIR

(75) Inventors: Rodney B. Hill, Silverton, OR (US); David P. Platt, Sherwood, OR (US)

(73) Assignee: Xerox Corporation, Stamford, CT (US)

( * ) Notice: Subject to any disclaimer, the term of this patent is extended or adjusted under 35 U.S.C. 154(b) by 240 days.

(21) Appl. No.: 10/752,950

(22) Filed: Jan. 7, 2004

(65) Prior Publication Data

US 2005/0146575 A1 Jul. 7, 2005

(51) Int. Cl.
*B41J 2/05* (2006.01)

(52) U.S. Cl. ..... 347/65

(58) Field of Classification Search ..... 347/54, 347/63, 65, 66, 71, 87, 93
See application file for complete search history.

(56) References Cited

U.S. PATENT DOCUMENTS 5,087,930 A * 2/1992 Roy et al. ..... 347/85
5,455,615 A * 10/1995 Burr et al. ..... 347/92
5,489,930 A * 2/1996 Anderson ..... 347/71
6,003,971 A 12/1999 Hanks et al.
6,325,499 B1 * 12/2001 Betschon ..... 347/86
6,343,857 B1 2/2002 Cowger
6,672,712 B1 1/2004 Donaldson et al.
2003/0027426 A1 2/2003 Milligan et al.
2003/0156161 A1 8/2003 Conta et al.

FOREIGN PATENT DOCUMENTS

DE 32 04 662 A1 8/1983
EP 1 172 214 A 1/2002
JP 04 235057 A 8/1992

OTHER PUBLICATIONS

European Search Report dated Apr. 15, 2005.

* cited by examiner

*Primary Examiner*—Anh T. N. Vo
(74) *Attorney, Agent, or Firm*—Fay, Sharpe, Fagan, Minnich & McKee, LLP

(57) ABSTRACT

A print head reservoir includes a plate having first and second sides and a passage extending through said plate. The plate defines an angled channel in communication with the passage and an outlet region.

18 Claims, 12 Drawing Sheets

PURGEABLE PRINT HEAD RESERVOIR

BACKGROUND

Ink jet printers create an image on a surface by ejecting ink through orifices in a print head face plate onto a substrate. The print head face plate communicates with a print head reservoir, which communicates with an ink source. Solid ink printers melt solid ink and deliver the melted ink to the print head reservoir.

When the solid ink printer is turned off, the ink that remains in the print head reservoir can freeze. When the ink thaws in the print head reservoir, air that was once in solution in the ink can come out of solution to form air-bubbles or air pockets in the print head reservoir. Air pockets can impede the filtering of the ink as it travels toward the orifices in the print head face plate. Air pockets can also impair the print quality of the printer when an air bubble, as opposed to ink, is delivered through the orifice resulting in an unintended blank spot on the print media. Accordingly, it is desirable to purge periodically the cavities and channels in the print head reservoir to increase print quality.

It is known to purge air out of solid ink print heads using a vacuum system, but a vacuum system is costly, time consuming and less efficient than a system that uses positive pressure. Furthermore, it is desirable to wipe the jets during purging, which is not possible when using a vacuum system. Accordingly, a positive pressure purge system is desirable. In a positive pressure purge system it is desirable to purge the print head using as little ink as possible.

BRIEF DESCRIPTION

A print head reservoir for a printer includes a plate having first and second sides and a passage extending through the plate. The plate defines an angled channel in communication with the passage and an outlet region located near an intersection of at least two adjacent sloping portions of the angled channel.

A print head reservoir for a printer includes a plate having a first surface and a second surface. The first surface defines a first channel and a second channel. The second surface defines a first ink cavity and a second ink cavity laterally spaced along the plate from the first ink cavity. The first ink cavity communicates with the first channel and the second ink cavity communicates with the second channel.

A print head reservoir for a printer includes an ink source and a plate. The plate includes a channel formed on a first surface, a passage extending through the plate and in communication with the channel and the ink source, and first and second outlet regions defined in the plate each in communication with the channel.

DETAILED DESCRIPTION

Figure 11:
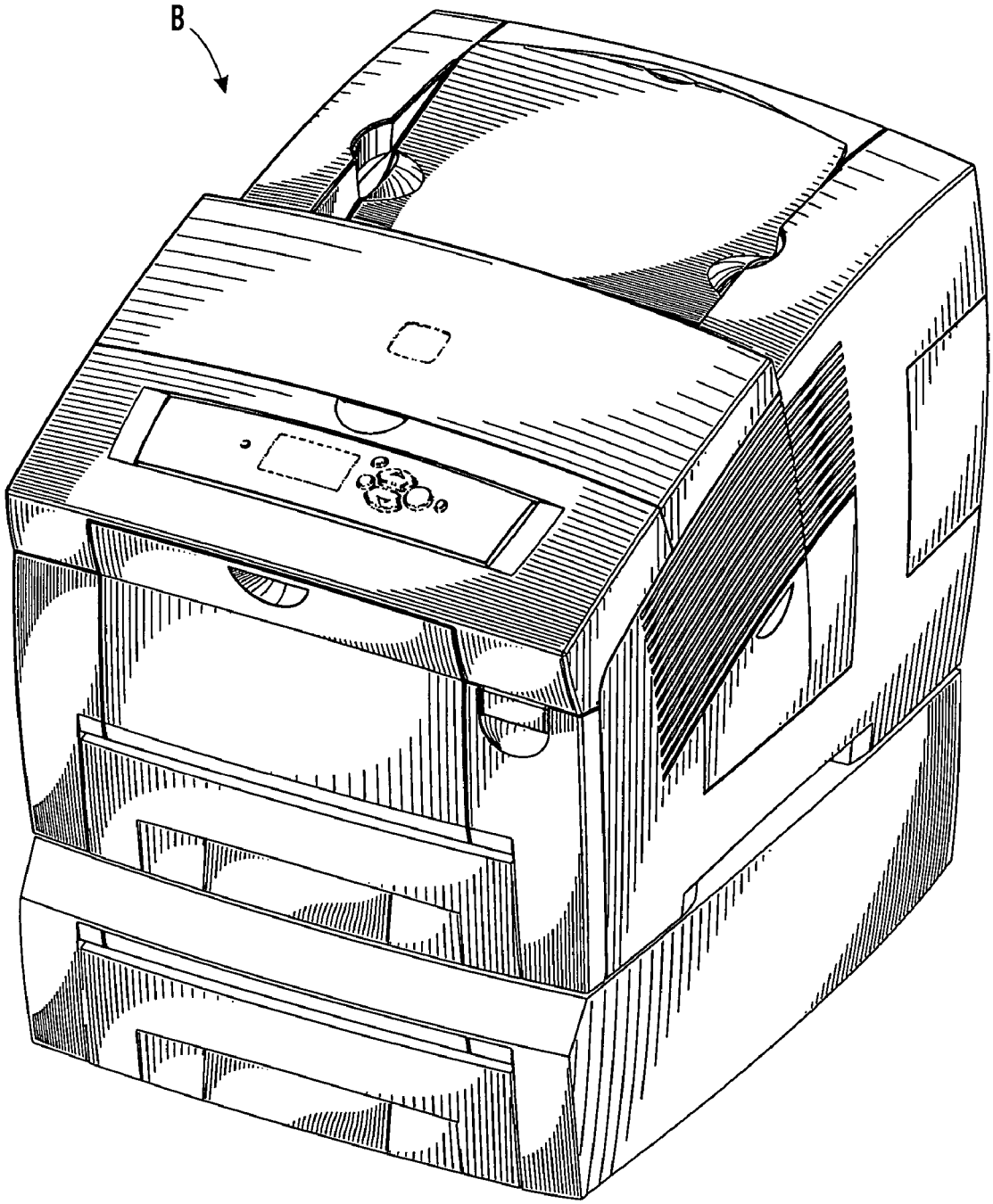
FIG. 11 is a perspective view of an ink jet printer that contains the print head reservoir of FIG. 1.
Figure 12:
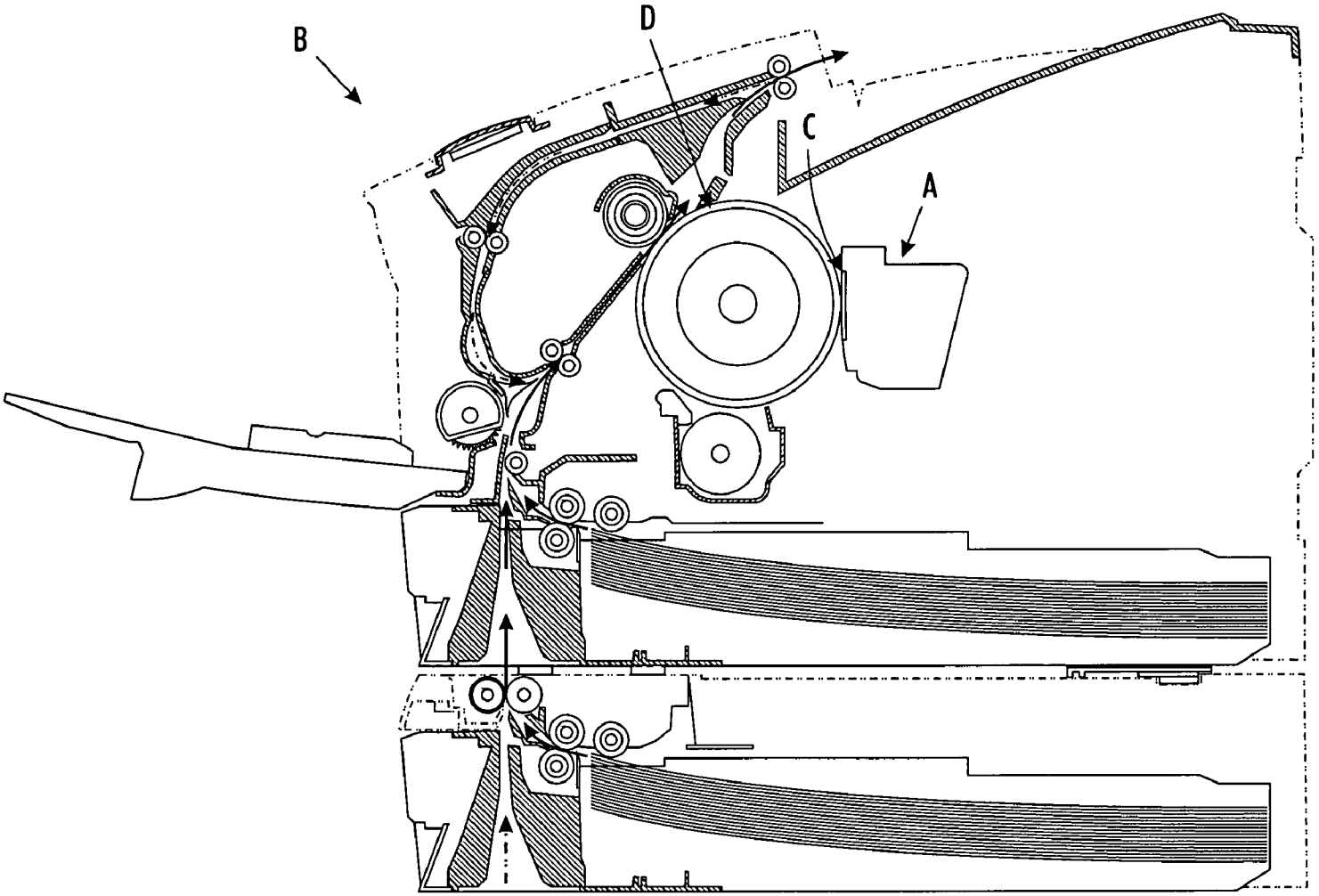
FIG. 12 is a cross-sectional view of the ink jet printer of FIG. 11.

Referring to FIGS. 11 and 12, a print head A for an ink jet printer B generally delivers liquid ink to a jet stack C that transfers the ink onto a drum D. The print media, which can include paper, travels around the drum and picks up the ink deposited on the drum. Air can get into the pathway of the ink as it travels through the print head. To remove the air from the pathway, the print head reservoir is purged, which will be described in more detail below.

Figure 1:
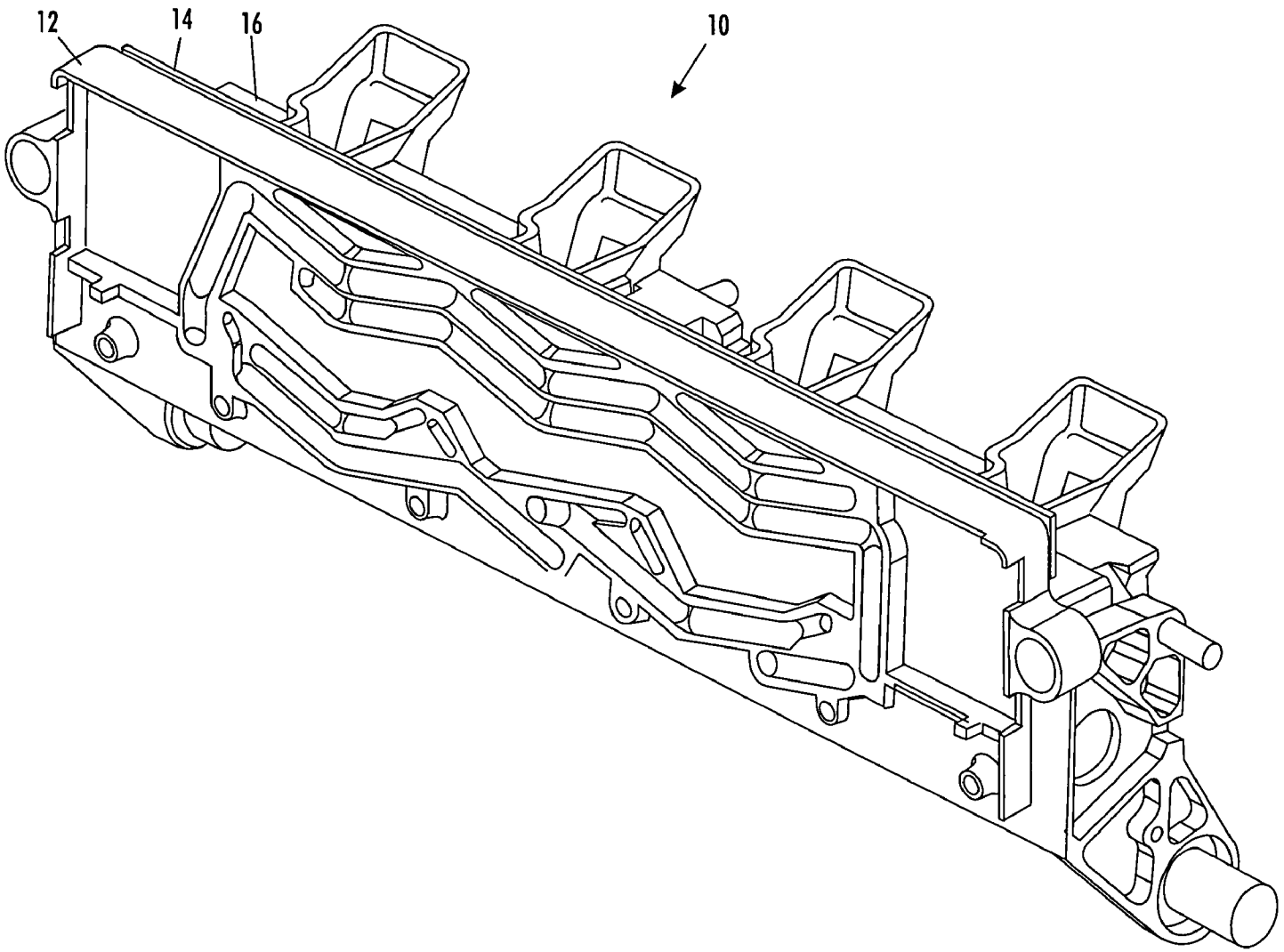
FIG. 1 is a front perspective view of a print head reservoir for an ink jet printer.

With reference to FIG. 1, a print head reservoir 10 includes a first or front plate 12, a second or middle plate 14 and a third or rear plate 16. The print head reservoir 10 is a portion of the print head and is situated inside the ink jet printer such that the bottom of each plate is substantially horizontal and the reservoir can rotate about a pair of journals 18 (only one visible in FIG. 1). The terms "front," "middle," and "rear" are used for ease of understanding to describe the components of the reservoir as they are shown in the figures; the terms are not used to limit the position of components in relation to one another.

Figure 2:
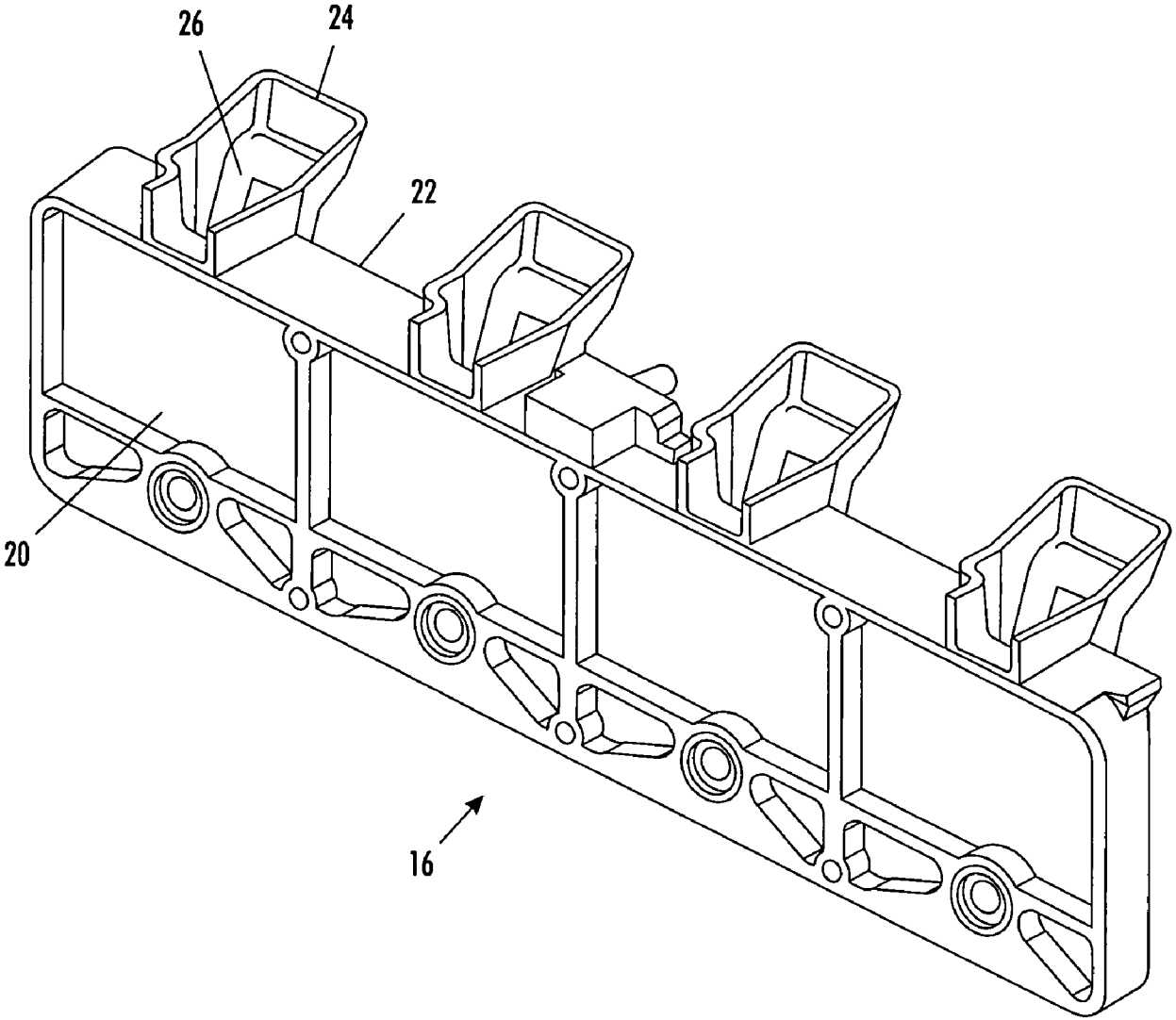
FIG. 2 is a front perspective view of a rear plate of the print head reservoir of FIG. 1.

Generally, the ink travels from the rear plate 16 towards the front plate 12. With reference to FIG. 2, the rear plate includes a front side 20 that is adjacent the middle plate 14 when the reservoir is assembled and a rear side 22 opposite the front side. A plurality of bucket walls 24 extend from the rear side 22 to define a plurality of ink buckets 26. In the embodiment depicted, four ink buckets are shown and each bucket receives a different color ink, particularly yellow, cyan, magenta and black; however, a fewer or greater number of ink buckets can be provided and the ink buckets can receive different colors of ink. The ink buckets 26 usually receive ink that has been melted and dripped into the buckets; however, liquid ink that has not been melted can also be delivered to the ink buckets.

Figure 3:
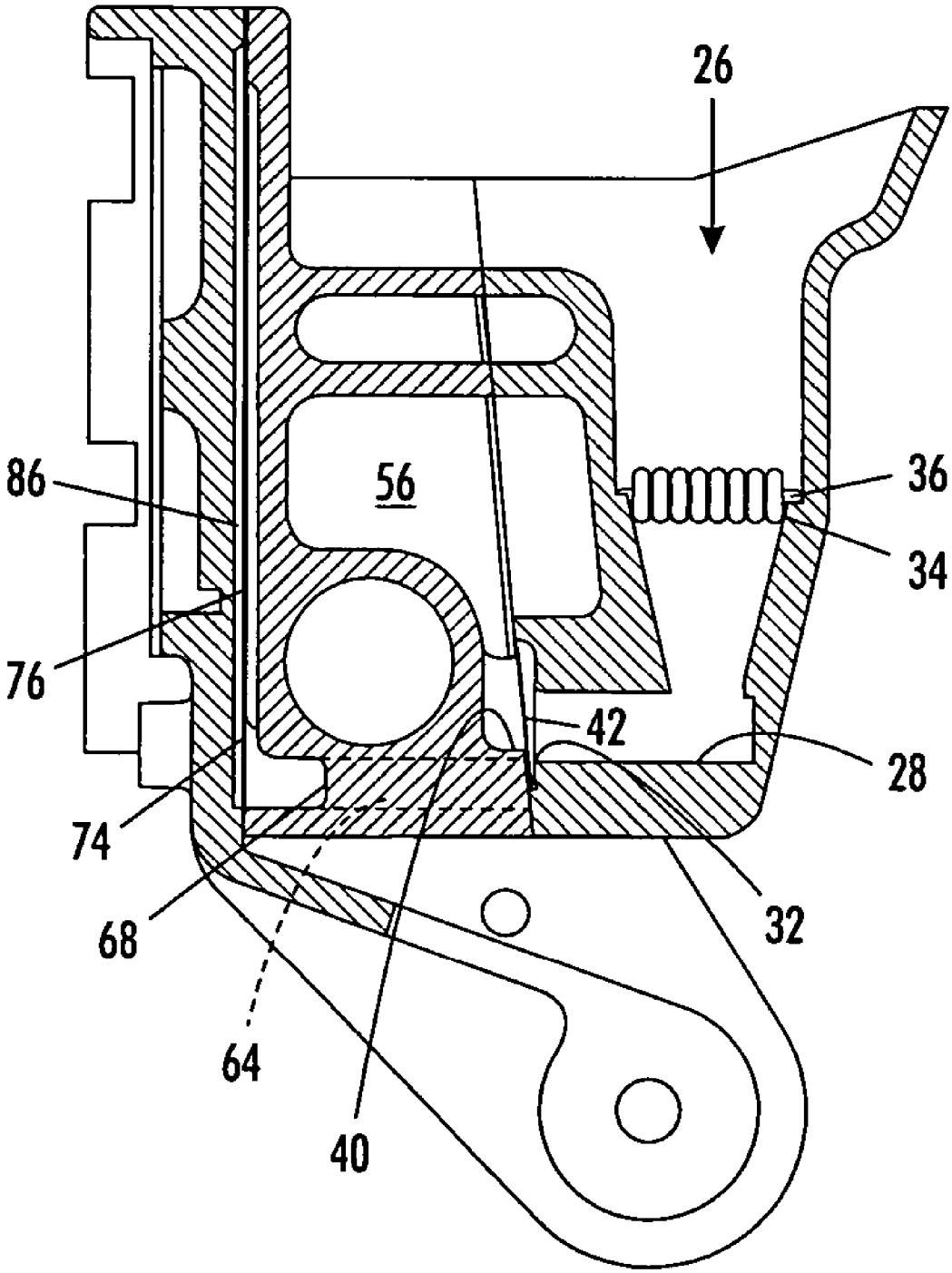
FIG. 3 is a view of a side cross-section of the print head reservoir of FIG. 1.

With reference to FIG. 3, each ink bucket 26 communicates with a passage 28 which communicates with a rear plate outlet 32. A filter 34 is disposed in each ink bucket on a shoulder 36 that projects inwardly from the bucket wall 24 into the ink bucket 26. The filter 34 removes any impurities in the ink before the ink travels into the passage 28 and towards the rear plate outlet 32. The rear plate outlet 32 communicates with a middle plate inlet 40 through a valve member 42. The valve member 42 comprises a component of a one-way check valve that allows ink to pass from the rear plate outlet 32 into the middle plate inlet 40. The valve member 42 precludes ink from passing from the middle plate inlet 40 back into the rear plate outlet 32. The valve member 42 opens and closes in response to a pressure differential between the rear plate outlet 32 and the middle plate inlet 40.

Figure 4:
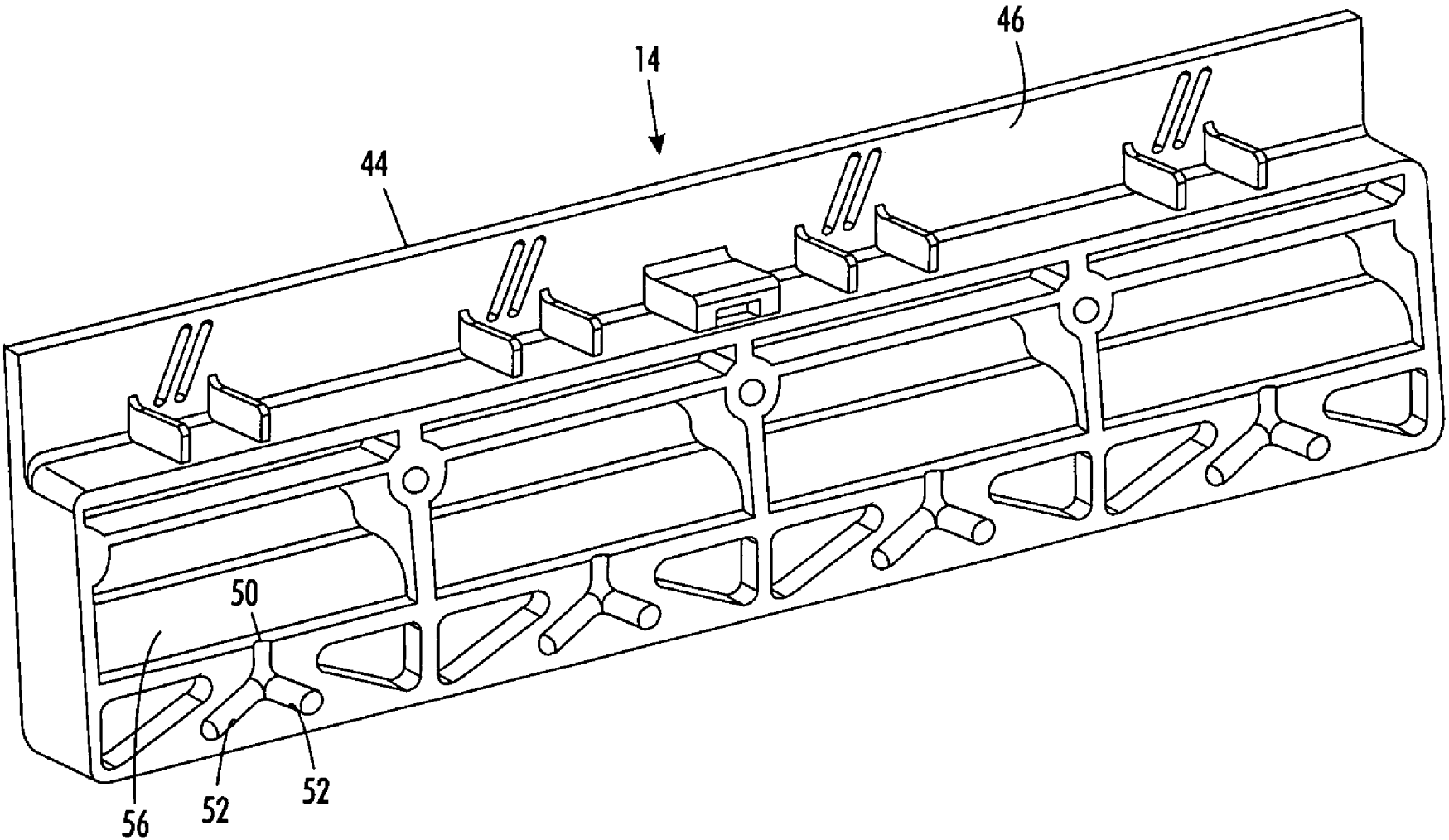
FIG. 4 is a rear perspective view of a middle plate of the print head reservoir of FIG. 1.
Figure 6:
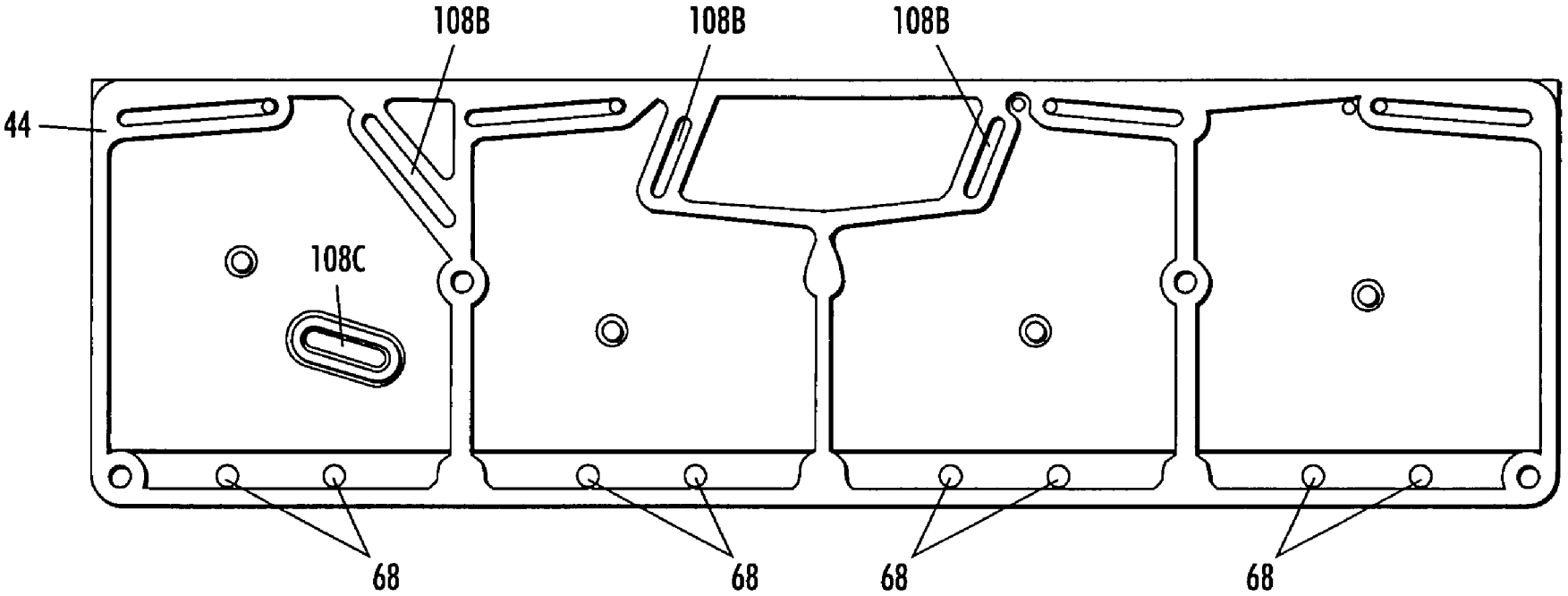
FIG. 6 is an elevation view of the front side of the middle plate of FIG. 4.

Referring to FIG. 4, the middle plate 14 includes a front side 44 and a rear side 46. The front side 44 of the middle plate abuts the front plate 12 and the rear side 46 of the middle plate abuts the front side 20 of the rear plate 16. The middle plate inlet 40 includes three lobes situated 120 degrees apart from one another formed in the rear side 46 of the middle plate 16. Two lobes 52 depend generally downward and the third lobe 50 extends upward to communicate with an ink chamber 56. Each downward depending lobe 52 includes an opening 58 that communicates with a passage 64 (only one shown in phantom in FIG. 3) which communicates with a middle plate outlet 68 on the front side 44 of the middle plate 14. As seen in FIG. 6, eight middle plate outlets 68 are provided at the bottom of the front side 44 of the middle plate, two for each color of ink. A greater or fewer number of middle plate outlets can be provided.

Figure 5:
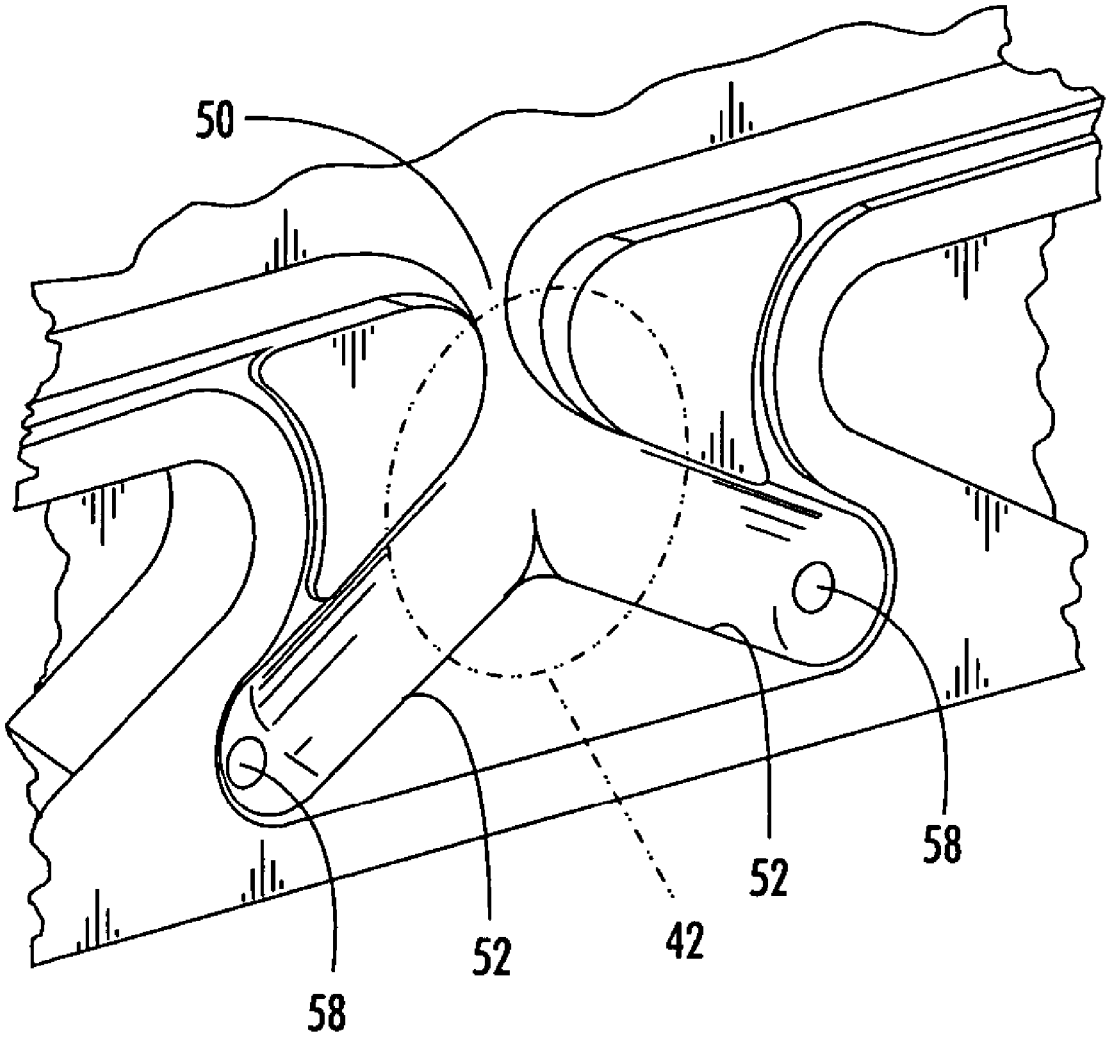
FIG. 5 is a close up view of an inlet of the middle plate of FIG. 4.

With reference back to FIG. 4, ink flows into the middle plate inlet 40 and into the ink chamber 56 through the upward lobe 50. Ink exits the ink chamber through openings 58 (FIG. 5) in the downward lobes 52. The ink chamber 56 is defined as a depression in both the rear side 46 of the middle plate 14 and the front side 20 of the rear plate 16, as seen in FIG. 3. Ink exits the middle plate outlets 68, which are in communication with the passages 64 (only one shown), and enters an upstream filter cavity 74.

A vertical filter 76 is sandwiched between and situated substantially parallel to the front plate 12 and the middle plate 14. The upstream filter cavity 74 is defined between the front side 44 of the middle plate 14 and the filter 76. As more clearly seen in FIG. 7, the filter 76 includes two layers, a first layer 78 made of a fine screen and a second layer 82 made of a felt material. Each of the filters can remove impurities as small as 10 microns from the ink. Ink flows through the filter 76 from the upstream filter cavity 74 into a downstream filter cavity 86, which will be described in more detail below.

Figure 8:
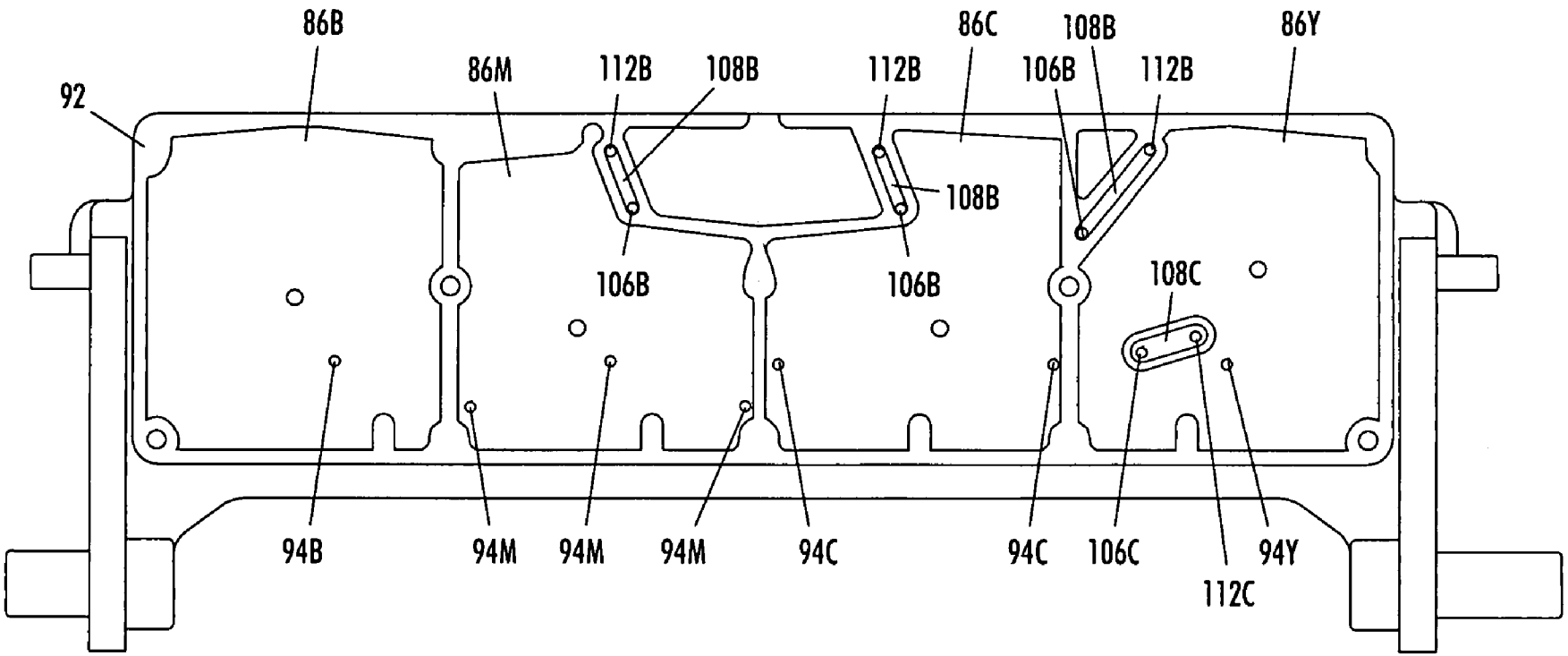
FIG. 8 is an elevation view of the rear side of a front plate of the print head reservoir of FIG. 1.

The front plate 12 includes a front side 90 (FIG. 9) and a rear side 92 (FIG. 8), which is adjacent the filter 76. The downstream filter cavity 86 is defined between the filter 76 and the rear side 92 of the front plate 12. Referring to FIG. 8, the front plate 12 includes a plurality of openings 94 on the rear side 92 that communicate through passages with a plurality of front plate outlets 96 (FIG. 9) on the front side 90 of the front plate. For ease of understanding the figures only, not as limiting the embodiment, the openings and front plate outlets will be described as having a certain color ink flowing through them.

The rear side 92 of the front plate 12 includes four depressions that define four downstream filter cavities 86. The downstream cavities will be referred to as 86B, 86M, 86C and 86Y, where the letter refers to the color of ink (black, magenta, cyan and yellow) in the downstream cavity. As can be seen in FIG. 8, some downstream filter cavities have more than one opening 94, thus on the front side 90 of the front plate 12 more than one plate outlet 96 can be provided for a particular color. For example, the black downstream filter cavity 86B has one opening 94B, the magenta downstream filter cavity 86M has three openings 94M, the cyan downstream filter cavity 86C has two openings 94C and the yellow downstream filter cavity 86Y has one opening 94Y. Each of these openings 94 communicates with a corresponding front plate outlet 96 (FIG. 9) through a passage.

Figure 9:
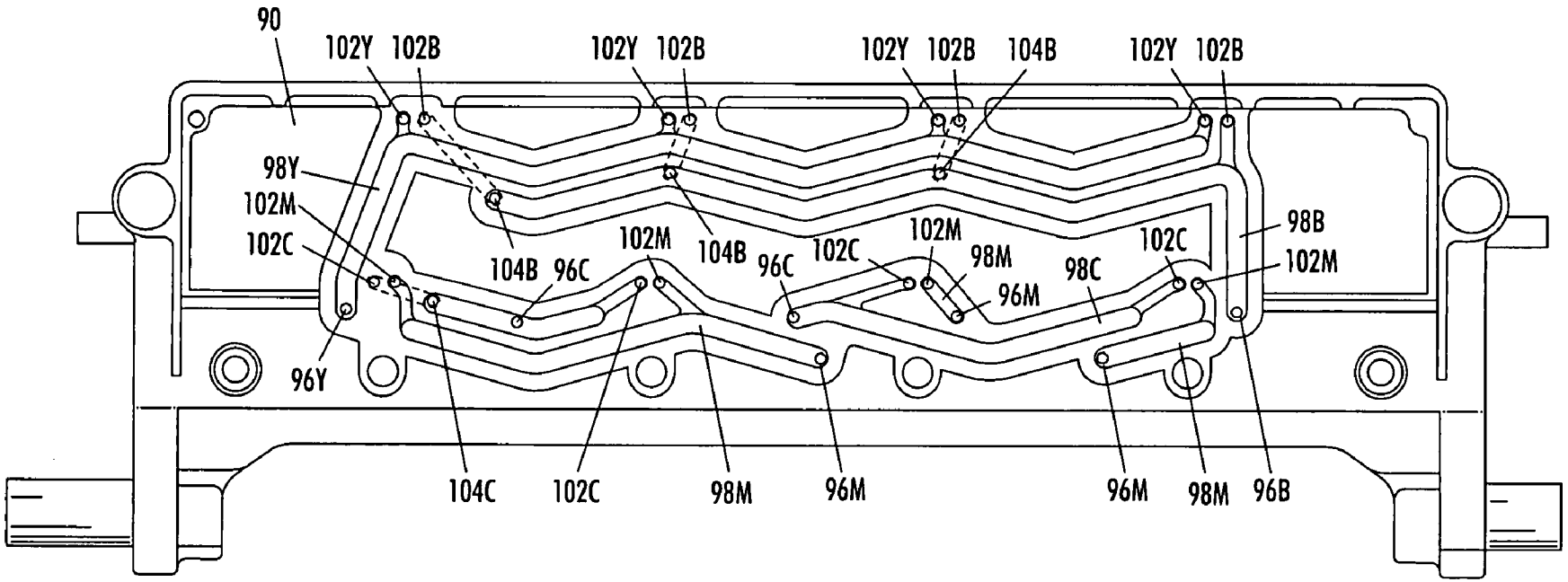
FIG. 9 is an elevation view of the front side of the front plate of FIG. 8.
Figure 10:
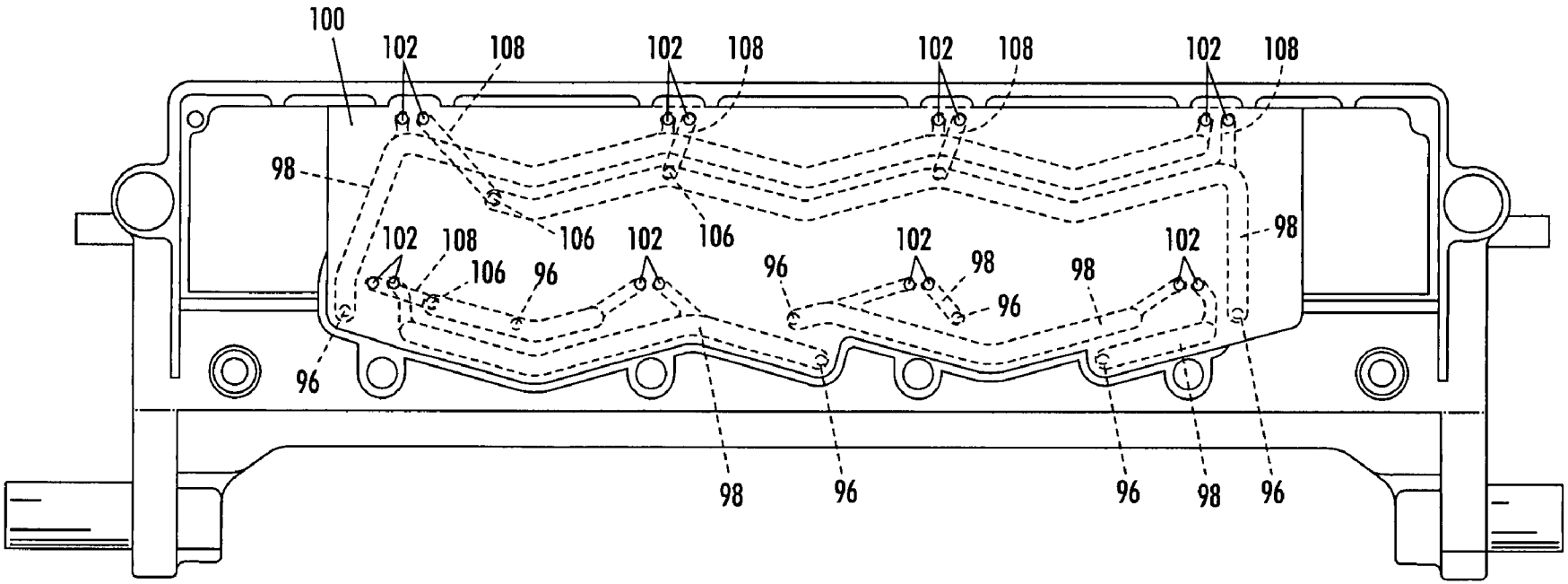
FIG. 10 is a front elevation view of the print head reservoir of FIG. 1 including a fourth plate attached to the front side of the front plate.

With reference to FIG. 9, the front side 90 of the front plate 12 includes a plurality of angled channels 98 formed in the plate. Each front plate outlet 96 is disposed in an angled channel. The channels 98 deliver ink laterally across the front plate 12 to a plurality of corresponding outlet regions 102, where the ink can pass through a fourth plate 100 (FIG. 10) en route to the jet stack (not shown). In the embodiment depicted, each color has four outlet regions 102 equally spaced laterally along the front plate. For ease of explanation of the embodiment disclosed, and not to be deemed as limiting, the channels and the outlet regions will be referred to with a suffix following the reference numeral that corresponds to the color of ink that travels through the channel toward the outlet region.

Figure 7:
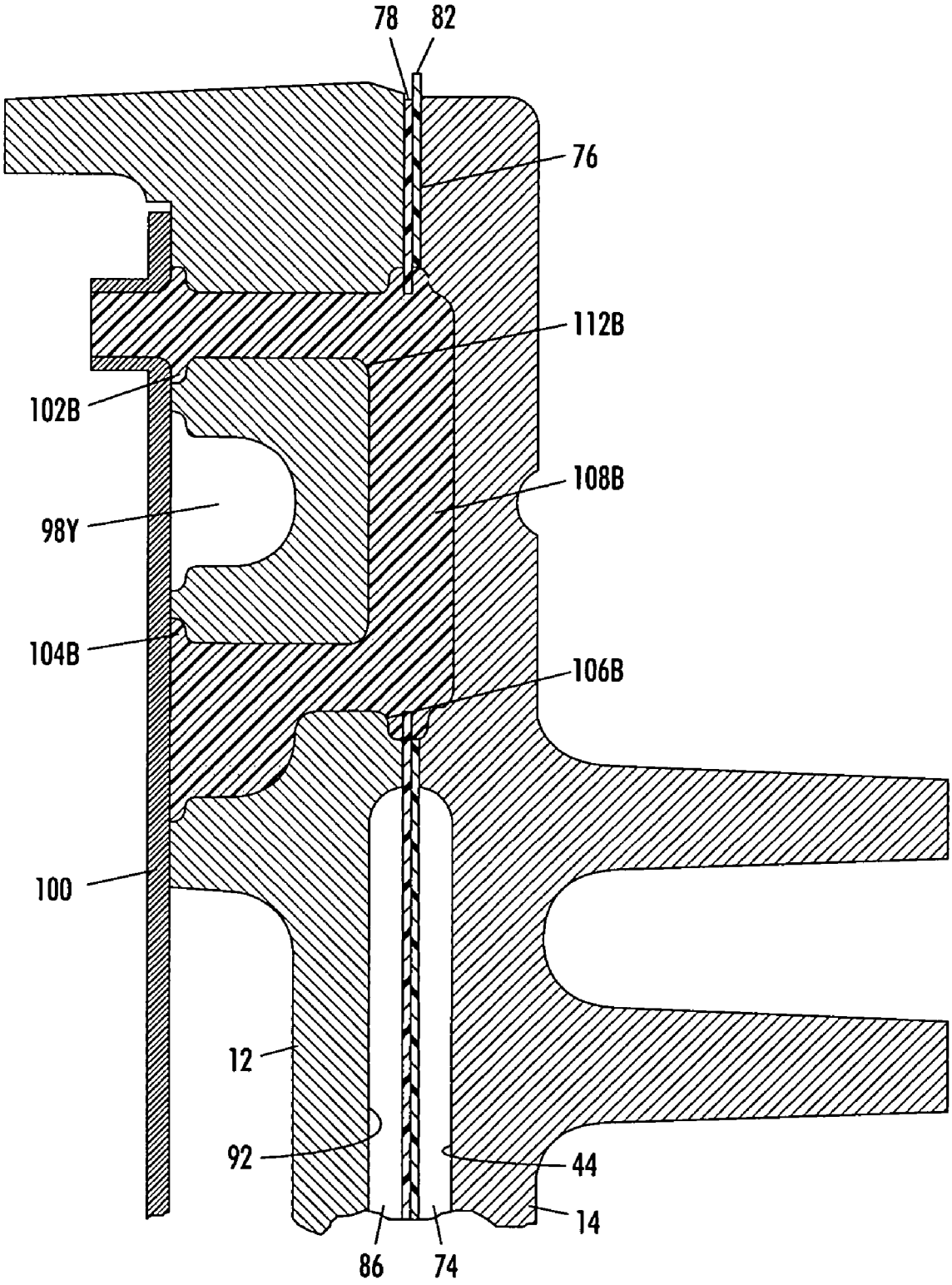
FIG. 7 is a close up cross section of the upper portion of the print head reservoir of FIG. 1.

As seen in FIG. 9, channel 98Y receives yellow ink from front plate outlet 96Y and delivers the yellow ink to four outlet regions 102Y evenly spaced laterally along and near the top of the front side 90 of the front plate 12. Channel 98B receives black ink from front plate outlet 96B and delivers black ink to four outlet regions 102B situated next to the yellow outlet regions 102Y. To deliver black ink to three of the outlet regions 102B would require the black ink channel 98B to cross over the yellow ink channel. To route the black ink to the outlet regions 102B without crossing over the yellow ink channel 98Y, channel openings 104B are provided at the apex of angled portions of the black channel 98B. The channel openings 104B communicate through a passage to corresponding underpass inlets 106B in the rear side 92 of the front panel 12 (FIG. 8). The underpass inlets 106B communicate with corresponding underpass channels 108B formed on the rear side 92. The underpass channels lead to underpass outlets 112B which communicate through a passage with a corresponding outlet region 102B on the front side 90 of the front plate 12 (FIG. 9). This is also shown in cross-section in FIG. 7. As shown in FIGS. 6, 7and 8 the underpass channels 108B are formed as depressions in both the rear side 92 of the front plate 12 and the front side 44 of the middle plate 14.

Referring back to FIG. 9, two separate channels 98C are provided to carry cyan ink towards four outlet regions 102C evenly spaced laterally along and near the bottom of the front plate 12. As depicted in FIG. 9, the left most first plate outlet 96C communicates with the left channel 98C to deliver cyan ink to the two left outlet regions 102C. The left channel also includes a channel opening 104C, similar to the channel opening described above. The channel opening 104C communicates through a passage to a corresponding underpass inlet 106C (FIG. 8) in the rear side 92 of the front panel 12. The underpass inlet 106C communicates with a corresponding underpass channel 108C formed on the rear side 92. The underpass channel 108C leads to an underpass outlet 112C which communicates through a passage with a corresponding left most outlet region 102C (as shown in FIG. 9) on the front side 90 of the front plate 12. With reference to FIG. 6, the cyan underpass channel 108C is also defined on the front side 44 of the middle plate 14. Three channels 98M in communication with three magenta front plate outlets 96M carry magenta ink towards four outlet regions 102M. Each magenta outlet region 102M is situated next to a corresponding cyan outlet region 102C.

As mentioned earlier, melted ink travels through the printer reservoir 10. When the printer is turned off, the ink can freeze in the printer reservoir. During the freeze process, air comes out of solution that was previously dissolved in the liquid ink. When the printer is turned back on and the printer reservoir is warmed up, the air that has come out of solution is left as bubbles in the liquid ink.

One area of the printer reservoir 10 where the air bubbles can form is in the channels 98 on the front side 92 of the first plate 12. The channels are angled or sloped towards the outlet regions 102 to encourage the air bubbles to passively move toward the outlet regions through buoyancy of the air bubble. As seen in FIG. 9, the outlet regions 102 are located at the apex of angled portions of the channels 98. With the air bubbles moved towards the outlet regions 102, purging the air bubbles out of the channels 98 requires a minimal amount of ink. Purging the channel is, generally, passing enough ink through the channel 98 to expel any air bubbles that have formed in the channel. The ink can be passed through the channels at a greater pressure during a purge cycle by, for example, forcing air into the ink chambers 56 by way of an air pressure source, which is in communication with the channels 98. The particular angle or slope of the channel is determined such that large bubbles generate enough unconstrained buoyancy to overcome the surface tension holding them in position.

The exemplary embodiment has been described with reference to the preferred embodiments. Obviously, modifications and alterations will occurto others upon reading and understanding the preceding detailed description. It is intended that the exemplary embodiment be construed as including all such modifications and alterations insofar as they come within the scope of the appended claims or the equivalents thereof.

The invention claimed is:

1. A print head reservoir for an ink jet printer comprising:

a plate having first and second sides and a passage extending through said plate, said plate defining a channel in communication with the passage and an outlet region located near an intersection of at least two adjacent sloping portions of the channel, the at least two adjacent sloping portions being sloped with respect to horizontal enough to allow air bubbles that form in ink traveling through the channel to generate enough unconstrained buoyant force to overcome a surface tension force holding the bubbles in position.

2. The reservoir of claim 1, further comprising an ink bucket in communication with the passage.

3. The reservoir of claim 2, further comprising a filter interposed between the channel and said ink bucket, wherein said filter is situated substantially parallel to said plate.

4. The reservoir of claim 3, further comprising an additional plate, wherein said filter is sandwiched between said plate that defines the channel and said additional plate.

5. The reservoir of claim 1, wherein the channel is adapted to carry a first color of ink, the reservoir further comprising an additional channel formed in said plate and passing underneath the channel adapted to carry a first color of ink.

6. The reservoir of claim 5, wherein the channel adapted to carry a first color of ink is formed on the first side of said plate and the additional channel includes at least a portion formed on the second side of said plate.

7. The reservoir of claim 5, wherein the additional channel is adapted to carry a second color of ink.

8. A reservoir for a printer comprising:

an ink source; and a plate including a channel formed on a first surface, a passage extending through said plate and in communication with the channel and said ink source, and a first outlet region defined in said plate in communication with the channel, the first outlet region being positioned at or adjacent an apex of two adjacent angled portions of the channel.

9. The reservoir of claim 8, further comprising a second ink source and wherein said plate further includes a second channel formed on the first surface, a second passage extending through said plate and in communication with the second channel and said second ink source, and a second outlet region defined in said plate and in communication with the second channel.

10. The reservoir of claim 8, further comprising a second ink source and said plate further including a second channel formed on a second surface opposite the first surface, a second passage extending through said plate and in communication with the second channel and said second source, and a second outlet region defined on the first surface of said plate and in communication with the second channel, wherein the second channel passes underneath the channel formed on the first surface.

11. The reservoir of claim 10, wherein said filter is disposed substantially parallel to said plate.

12. The reservoir of claim 8, further comprising a filter interposed between said ink source and the channel.

13. The reservoir of claim 8, wherein the channel is angled enough to allow bubbles found in ink that flows through the channel to generate enough unconstrained buoyancy to overcome a surface tension force holding the bubbles in position.

14. A print head reservoir for a printer, the print head reservoir comprising:

a first plate having a first surface and a second surface, the first surface defining a first channel and a second channel, the second surface at least partially defining a first ink cavity and a second ink cavity laterally spaced along said first plate from the first ink cavity, wherein the first ink cavity communicates with the first channel and the second ink cavity communicates with the second channel;

a second plate including a first surface and a second surface, at least a portion of the first surface of the second plate at least partially defining the first ink cavity and the second ink cavity, and a filter disposed between the first plate and the second plate.

15. The reservoir of claim 14, further comprising first and second ink buckets each adapted to store a different color liquid ink, wherein said first ink bucket communicates with the first ink cavity and said second ink bucket communicates with the second cavity.

16. The reservoir of claim 14, wherein the first channel runs laterally across the first surface of the plate to distribute a particular color ink to an area on the first surface that is aligned with an ink cavity defined in the second surface that holds a different color of ink.

17. The print head reservoir of claim 14, wherein the filter and the second side of the first plate define a downstream filter cavity.

18. The print head reservoir of claim 14, wherein the filter and the first side of the second plate define an upstream filter cavity.

* * * * *